US006439664B1

(12) United States Patent
Gorgi

(10) Patent No.: US 6,439,664 B1
(45) Date of Patent: Aug. 27, 2002

(54) HEIGHT ADJUSTMENT DEVICE, PARTICULARLY FOR THE SEAT BACK PORTION AND ARM-RESTS IN OFFICE CHAIRS

(75) Inventor: Claudio Gorgi, Rossano Veneto (IT)

(73) Assignee: Imarc S.p. A. (IT)

( * ) Notice: Subject to any disclaimer, the term of this patent is extended or adjusted under 35 U.S.C. 154(b) by 0 days.

(21) Appl. No.: 09/926,071

(22) PCT Filed: Mar. 2, 2000

(86) PCT No.: PCT/EP00/01791

§ 371 (c)(1),
(2), (4) Date: Aug. 24, 2001

(87) PCT Pub. No.: WO00/53058

PCT Pub. Date: Sep. 14, 2000

(30) Foreign Application Priority Data

Mar. 9, 1999 (IT) ..... VE99U0008

(51) Int. Cl.[7] ..... A47C 7/54
(52) U.S. Cl. ..... 297/411.36; 297/353
(58) Field of Search ..... 297/353, 411.36, 297/410

(56) References Cited

U.S. PATENT DOCUMENTS 4,639,039 A * 1/1987 Donovan ..... 297/353
5,597,204 A * 1/1997 Karaus, Jr. ..... 297/353
6,155,643 A * 12/2000 Gorgi et al. ..... 297/353

FOREIGN PATENT DOCUMENTS

GB 9457 1/1914
WO WO 98/09553 3/1998

* cited by examiner

*Primary Examiner*—Peter R. Brown
(74) *Attorney, Agent, or Firm*—Hoffman, Wasson & Gitler, PC

(57) ABSTRACT

A height adjustment device, in particular for seat back portions and arm-rests in office chairs, comprising a guide element (14, 48) rigid with the support plate (10) for the seating portion (12), a slide (22, 42) supporting the movable part (18, 20) and engagable with and slidable along said guide element, and means (38) selectively engagable in one of a plurality of teeth (31) to provide a configuration of stability, said selectively engagable means sliding freely along the passive flanks of the teeth of the toothed portion during the raising of the movable part, and lockable by the active flanks each time a tooth is passed over, said selectively engagable means being disengagable, for a predetermined position of said slide (22, 42) relative to said guide element (14, 48), from said teeth thus enabling said slide to move by gravity along said guide element, characterized in that said toothed portion (28) is faced by a toothed counter-portion (32) the teeth (34) of which form with the teeth (31) of said toothed portion (28) a mixed-line channel, the roots (30, 33) of the teeth (31, 34) of said toothed portion (28) and counter-toothed portion (32) forming respectively the seat of stable configuration and of temporary obstacle to the movement of said selectively engagable means along the mixed-line channel.

11 Claims, 3 Drawing Sheets

HEIGHT ADJUSTMENT DEVICE, PARTICULARLY FOR THE SEAT BACK PORTION AND ARM-RESTS IN OFFICE CHAIRS

This invention relates to a height adjustment device, particularly for the seat back portion and arm-rests in office chairs.

Office chairs are known comprising a spoke-type base with feet or wheels, a column mounted on said base and provided with a gas piston for adjusting the height of the sitting plane from the floor, and a support plate supported by said column, and on which the seating portion rests.

The back-rest support bracket and the arm-rest support brackets are generally connected to the seating portion support plate.

IT-B-1.288.164, filed in the name of the present applicant, describes a device for adjusting the seat back portion comprising a guide element rigid with the support plate of the seating portion, a back-rest support slide engagable with said guide element and slidable along it, and elastic means selectively engagable with a toothed portion to ensure the stability of the position of the slide relative to the guide.

This device has however proved to be susceptible to improvement both with regard to the ease finding the correct position of the arm-rest and/or seat back portion relative to the seating portion, and with regard to avoiding undesirable slippage of the arm-rest or seat back portion relative to the seating portion if the chair is lifted via these parts.

This improvement is attained according to the invention by a height adjustment device, in particular for seat back portions and arm-rests in office chairs, as claimed in claim 1.

The invention is described in detail hereinafter with reference to the accompanying drawings, on which:

Figure 1:
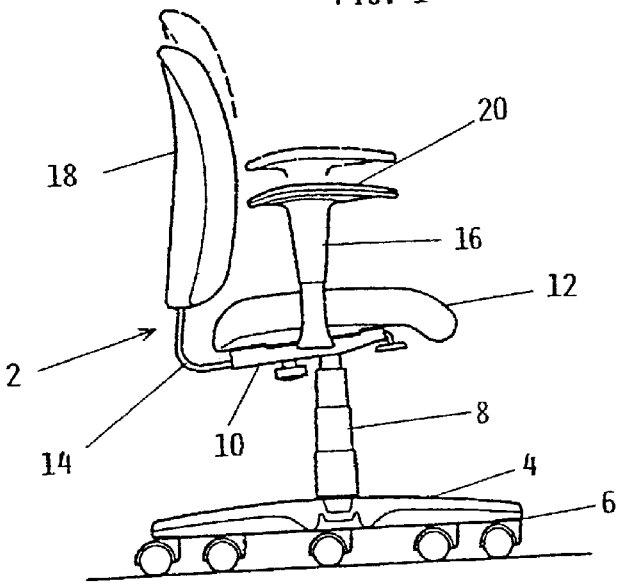
FIG. 1 is a schematic side view of a seat provided with the device of the invention both for the seat back portion and for the arm-rest.
Figure 10:
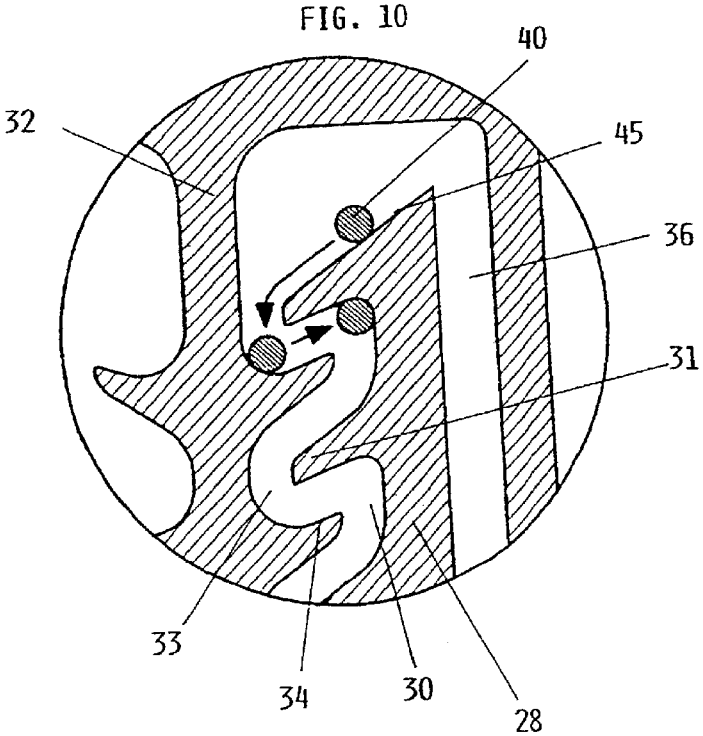
FIG. 10 is an enlarge detailed view of a tooth and counter-tooth.

As can be seen from the figures the device of the invention is applied to a traditional office chair 2 comprising a spoked base 4 with feet or wheels 6, a column 8 mounted on said base and, for the seating portion 12, a support plate 10 to which are connected the brackets 14, 16 supporting the back-rest 18 and the arm-rest 20 respectively.

In the ensuing description reference is made to those bracket components supporting the seat back portion, but the same is applicable to the arm-rest components.

To the seat back portion there is applied a support 22 formed of substantially rigid plastic and provided with holes 23 for the passage of screws which engage the back-rest 18. Said support has an internal seat 24 for its guiding along the bracket 14 and comprising a cavity 26 with projections shaped to define two mutually facing toothed portions 28, the cavity 30 between adjacent teeth 31 facing downwards when the chair is assembled, and a further portion 32 interposed between the two toothed portions 28 and provided with upwardly facing counter-teeth 34 which partially occupy each tooth cavity 30. In this manner said teeth 30 and counter-teeth 34 form a mixed-line path the purpose of which is described hereinafter.

The outer surfaces of the two toothed portions 28 form two parallel channels 36 with the lateral edges of the seat 26, and have their minor surfaces 37 diverging upwards.

A U-shaped spring 38 is fixed to the bracket 14 by a rivet 39 and is provided at its free ends with two appendices 40 bent at 90° and housed in the seat 26.

In the absence of external stress the distance between the appendices 40 of the spring 38 is less than the distance between the two longitudinal channels 36 but greater than the base of facing cavities 30.

The back-rest adjustment device operates in the following manner.

When in the configuration in which the back-rest is a minimum height (see FIG. 5) the appendices 40 lie substantially at the upper edge of the seat 26. To ensure this position the support 22 lies with its lower end on two stops 43.

To adjust the position of the back-rest the user pulls the supports 22 upwards with the result that initially the appendices 40 interact with the upper inclined surfaces 45 of the toothed portions 28 and approach each other until they pass over the first tooth, after which following the lifting action they interact with the cavity 33 of the counter-teeth 34, hence preventing any further pulling. The user then slightly pushes the support 22 downwards to enable the appendices 40 to disengage from the cavity 33 of the counter-teeth 34 and, as a result of the elastic action of the spring, position itself stably and accurately within that cavity 30 immediately downstream of the tooth which has just been passed over. This operation is repeated until the user has positioned the back-rest at the desired height.

Figure 9:
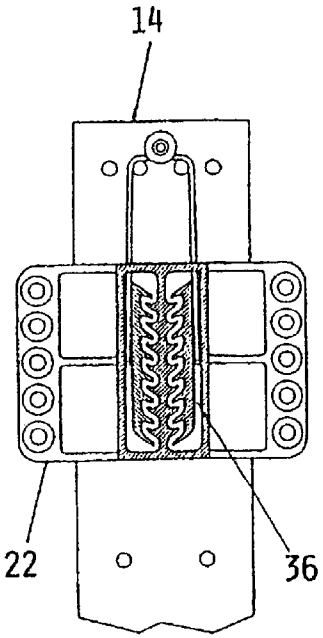
FIGS. 5–9 show the device during adjustment.
Figure 8:
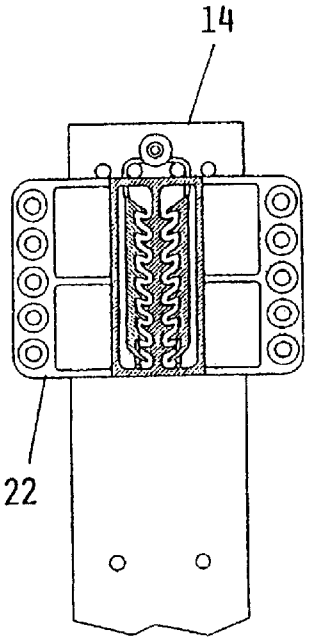
Figure 7:
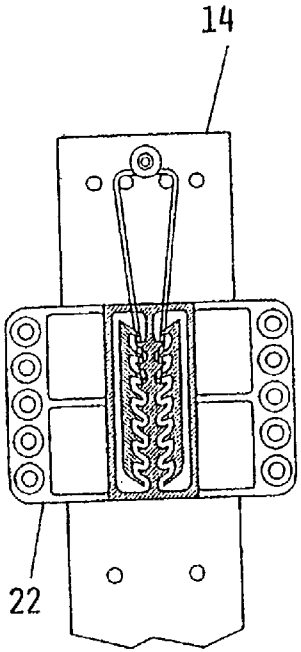
Figure 6:
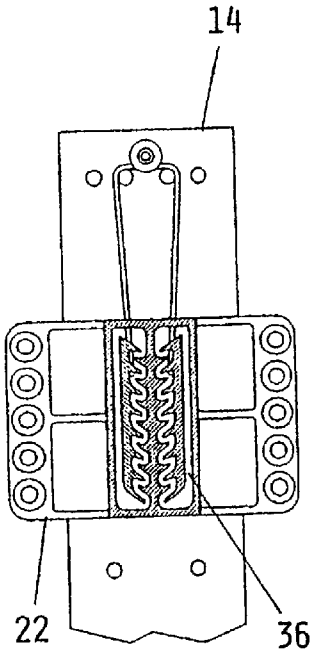
Figure 5:
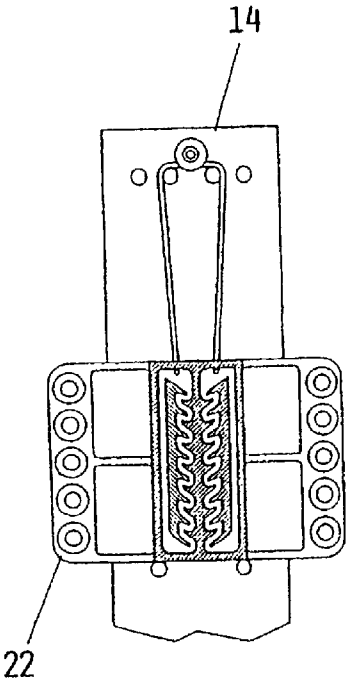

If this height proves excessive, to return the back-rest to a lower position the user continues to raise the support until the appendices 40 disengage from the lower teeth (see FIG. 8).The elastic reaction of the spring 38 then causes the appendices 40 to withdraw from each other and interfere with the inclined lower surface 37 of the toothed portion 28 to be guided into the longitudinal channels 36 where they can slide freely and enable the support 22 to slide downwards on the bracket 14 (see FIG. 9), to return to the position shown in FIG. 5.

From the aforestated it is apparent that the adjustment device of the invention presents numerous advantages, and in particular:

- it enables the back-rest and arm-rest to be positioned in a simple and convenient manner by a stepping operation,
- if the chair is lifted by the arm-rest or the seat back portion, it prevents the movable part from undesirably sliding along its bracket.

Figure 11:
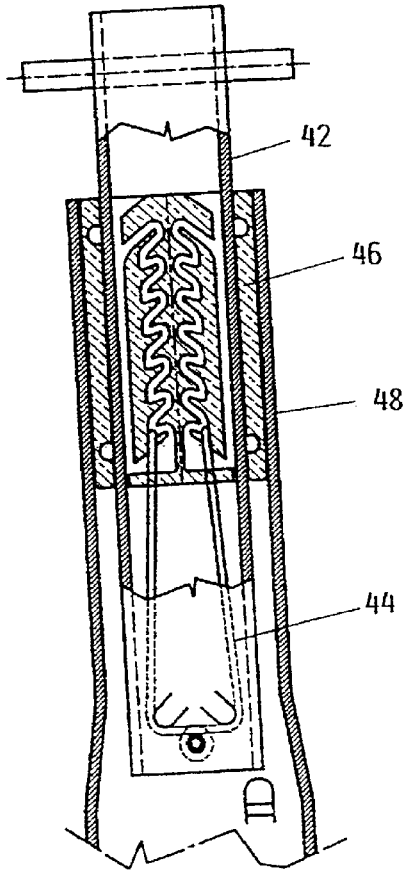
FIG. 11 shows a different embodiment of the device.
Figure 3:
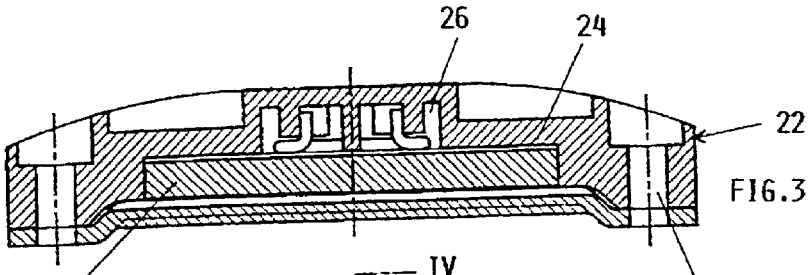
FIG. 3 is a longitudinal section on the line III—III of FIG. 2.
Figure 2:
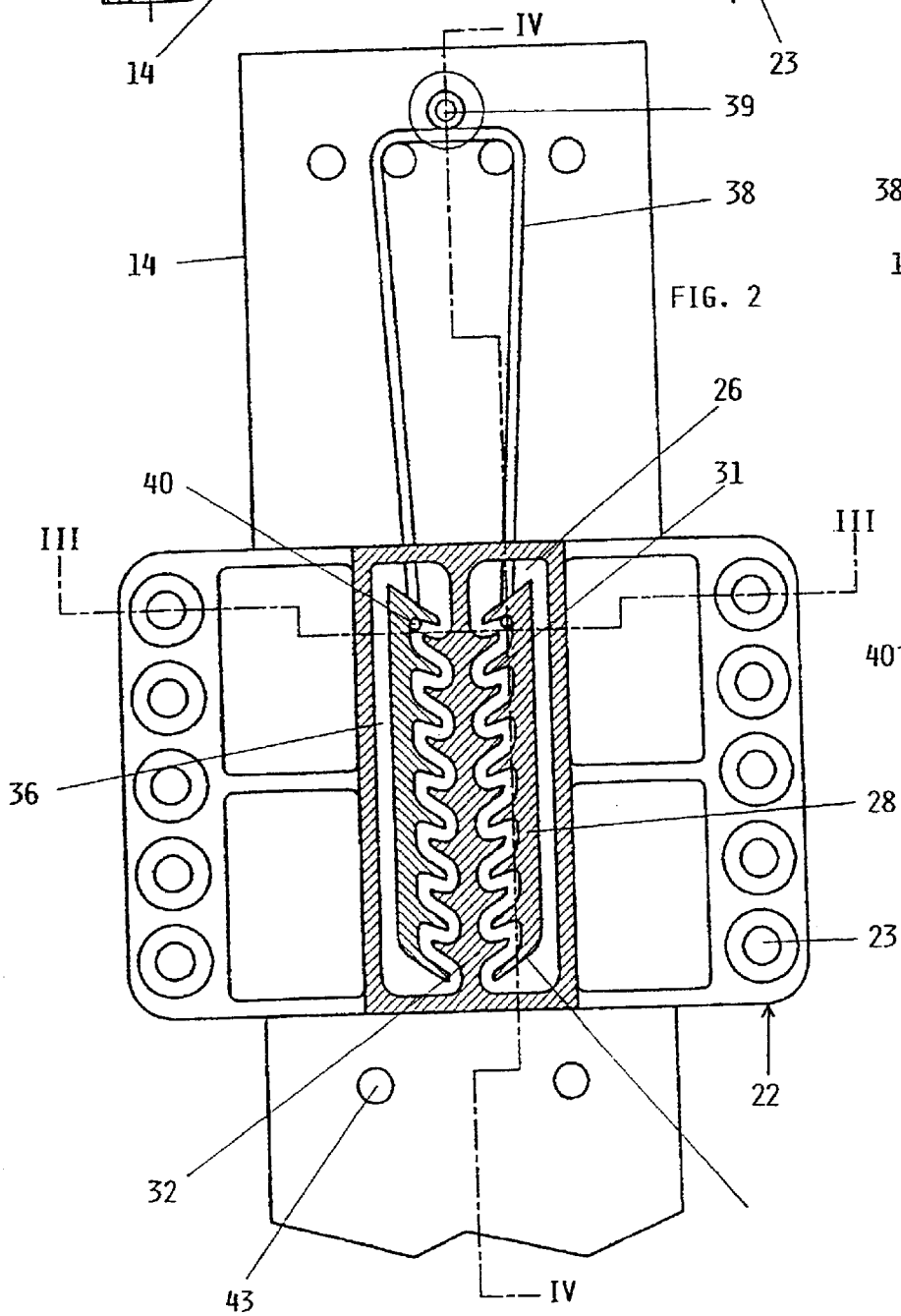
FIG. 2 is a sectional and transparent view of the adjustment device of the invention.
Figure 4:
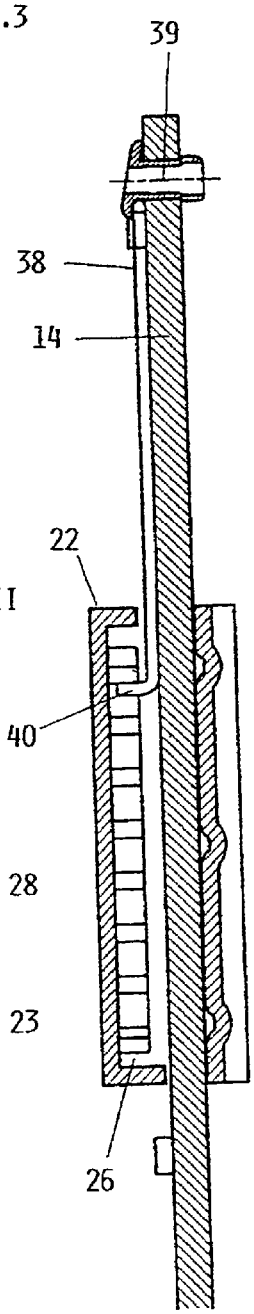
FIG. 4 is a cross-section on the line IV—IV of FIG. 2.

In the embodiment shown in FIG. 11, there is fixed to the seat back portion a substantially u-shaped first section bar to which a spring 44 is applied with its appendices bent at 90° to the section bar surface and engaging in a profiled piece 46 similar to the preceding and provided on a csection 48 having its flanges bent inwards.

What is claimed is:

1. A height adjustment device, comprising a seating portion having a support plate, a guide element rigid with the support plate for the seating portion, a movable part, a slide supporting the movable part and engagable with and slidable along said guide element, a toothed portion having a plurality of teeth, each tooth having a root, means selectively engagable in one of the plurality of teeth to provide a configuration of stability, said selectively engagable means being disengagable, for a predetermined position of said slide relative to said guide element, from said teeth thus enabling said slide to move by gravity along said guide element, wherein said toothed portion is faced by a toothed counter-portion having a plurality of teeth, each tooth having a root, the counter portion teeth and the teeth of said toothed portion forming a mixed-line channel, the roots of the teeth of said toothed portion forming a seat for the selectively engagable means and the roots of the counter-toothed portion forming a temporary obstacle to the movement of said selectively engagable means along a channel between the toothed portion and counter toothed portion.

2. A device as claimed in claim 1, wherein said selectively engagable means are associated with elastic means acting to cause the engagement with the teeth.

3. A device as claimed in claim 2, wherein said selectively engagable means are intrinsically elastic means.

4. A device as claimed in claim 2, wherein said elastic means consist of a substantially U-shaped spring with its ends bent at 90°.

5. A device as claimed in claim 1 wherein said toothed portions and counter-toothed portions are on the slide.

6. A device as claimed in claim 5, wherein said slide comprises a cavity having a surface facing the guide element, the toothing and counter-toothing formed by projections is the surface facing the guide element.

7. A device as claimed in claim 1, wherein said toothed portions and counter-toothed portions are on the guide element.

8. A device as claimed in claim 7, wherein said guide element consists of a C-shaped section bar with its flanges bent inwards and internally housing an insert forming the toothing and counter-toothing, said slide comprising a U-shaped section bar housing in its interior the C-shaped bar.

9. A height adjustment device, comprising a seating portion having a support plate, a guide element rigid with the support plate for the seating portion, a movable part, a slide supporting the movable part and engagable with and slidable along said guide element, a toothed portion having a plurality of teeth, each tooth having a root, a spring, said spring being disengagable, for a predetermined position of said slide relative to said guide element, from said teeth thus enabling said slide to move by gravity along said guide element, wherein said toothed portion is faced by a toothed counter-portion having a plurality of teeth, each tooth having a root, the counter portion teeth and the teeth of said toothed portion forming a mixed-line channel, the roots of the teeth of said toothed portion forming a seat for the spring and the roots of the counter-toothed portion forming a temporary obstacle to the movement of said spring along a channel between the toothed portion and counter toothed portion.

10. The device as claimed in claim 9, wherein said spring is a U-shaped spring with two ends, each end bent at an angle relative to the spring.

11. The device as claimed in claim 10, wherein said ends are bent at ninety degrees.

* * * * *